US006838666B2

(12) United States Patent
Ouyang et al.

(10) Patent No.: US 6,838,666 B2
(45) Date of Patent: Jan. 4, 2005

(54) RECTILINEAR ION TRAP AND MASS ANALYZER SYSTEM AND METHOD

(75) Inventors: Zheng Ouyang, West Lafayette, IN (US); Robert G. Cooks, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 10/656,667

(22) Filed: Sep. 4, 2003

(65) Prior Publication Data

US 2004/0135080 A1 Jul. 15, 2004

Related U.S. Application Data

(60) Provisional application No. 60/439,350, filed on Jan. 10, 2003.

(51) Int. Cl.[7] ..... H01J 49/42
(52) U.S. Cl. ..... 250/292; 250/282
(58) Field of Search ..... 250/292, 291, 250/290, 282, 281

(56) References Cited

U.S. PATENT DOCUMENTS 3,742,212 A * 6/1973 McIver, Jr. ..... 250/291
6,483,109 B1 * 11/2002 Reinhold et al. ..... 250/292

* cited by examiner

*Primary Examiner*—Jack I. Berman
(74) *Attorney, Agent, or Firm*—Dorsey & Whitney LLP

(57) ABSTRACT

A new geometry ion trap and its use as a mass spectrometer is described. The ion traps can be combined linearly and in parallel to form systems for mass storage, analysis, fragmentation, separation, etc. of ions. The ion trap has a simple rectilinear geometry with a high trapping capacity. It can be operated to provide mass analysis in the mass-selective instability mode as well as the mass-selective stability mode. Arrays of multiple ion traps allow combinations of multiple gas-phase processes to be applied to the trapped ions to achieve high sensitivity, high selectivity and/or higher throughput in the analysis of ions.

25 Claims, 14 Drawing Sheets

RECTILINEAR ION TRAP AND MASS ANALYZER SYSTEM AND METHOD

RELATED APPLICATIONS

This application claims priority to provisional application Ser. No. 60/439,350 filed Jan. 10, 2003.

BRIEF DESCRIPTION OF THE INVENTION

The present invention relates generally to an ion trap and an ion trap mass analyzer and more particularly to a rectilinear ion trap and mass analyzer employing a rectilinear ion trap.

BACKGROUND OF THE INVENTION

Three-dimensional ion traps with quadrupolar fields in both the r and z (in a polar coordinate system) direction impose linear forces on ions and can be used as traps for ions of wider or narrower ranges of mass/charge values. The field shapes are usually provided by a set of three electrodes, a ring electrode and two end cap electrodes of hyperbolic shape. Such devices are known as a Paul or quadrupole ion traps. In simpler alternative devices, the cylindrical ion traps (CITs), the inner surface of the ring is cylindrical and the end caps are flat.

The Paul trap and the cylindrical ion trap have known deficiencies. They include limits on the number of ions that can be trapped and low efficiencies for external ion injection. In order to minimize space charge effects and so achieve high resolution in commercial mass spectrometers, only 500 ions or fewer can be trapped in a typical experiment. The ion population injected through the entrance hole in the end cap electrode experiences the RF fields and only those ions injected at the right RF phase can be effectively trapped. Collision with buffer gas assists in trapping and the overall trapping efficiency for ions injected continuously is less than 5%, in many cases much less.

Another class of ion traps, the linear ion traps, address these problems. A linear ion trap includes elongated spaced multiple rods with RF and DC voltages applied to trap ions in the volume defined by the multipoles. A linear ion trap with elongated multipole rod sets is described in U.S. Pat. No. 6,177,668. A two dimensional RF field radially confines those trapped ions that fall in a mass range of interest. The ions are contained axially in the volume defined by the rods by a dc field applied to the end electrodes. Trapped ions are axially and mass selectively ejected by mixing of the degrees of freedom of the ions caused by fringing fields. U.S. Pat. No. 6,403,955 is directed to a quadropole ion trap mass spectrometer in which the trapping volume is defined by spaced rods. The motion of ions in the trapping volume produces image currents characteristic of the ions. U.S. Pat. No. 5,420,425 describes a linear quadrupole ion trap in which the ions are ejected through an elongated aperture formed in one of the spaced linear rods defining the trapping volume. All of the above ion traps, except the cylindrical ion trap, require accurate mechanical processing such as machining, assembly, etc., which is further complicated when making small portable mass analyzers employing ion traps.

U.S. Pat. No. 6,483,109 discloses a multiple stage mass spectrometer. One preferred embodiment includes a pulsed ion source coupled with a linear array of mass selective ion trap devices, at least one trap being coupled to an external ion detector. Each ion trap is configured with a storing cell for ion trapping interspersed between a pair of guarding cells, all aligned along their z axis. Radio frequency (RF) and direct current (DC) voltages are applied to electrodes of the ion trap device to retain ions within the storing cells. Each trapping cell has a sub-region in which the dynamic motion of the ion exhibits m/z-dependent resonance frequencies along the z direction, allowing the ion motion to be selectively excited by m/z value. The AC voltages can be combined with time-resolved changes in the applied DC voltages to enable individual trapping cell to be switched between ion trapping, mass selecting and ion fragmenting modes. Ions may be selectively transferred between ion traps, and selectively dissociated within each trap to enable an $MS^n$ operation. The linear array of ion traps comprises harmonic linear traps (HLTs) composed of a plurality of open cells. The cells of the HLTs are composed of parallelpiped rectangular electrodes oriented in the ZX and ZY planes with no rectangular electrode in the XY plane.

OBJECTS AND SUMMARY OF THE INVENTION

It is a general object of the present invention to provide an ion trap having a new and simple geometry.

It is another object of the present invention to provide an ion trap which allows trapping of gas phase ions in a simple geometry with high trapping capacity.

It is a further object of the present invention to provide an ion trap which can be operated to provide mass analysis in the mass-selective instability mode, as well as the mass-selective stability mode and the destructive detection modes common to other traps. Alternatively mass analysis can easily be performed using nondestructive detection modes just as it is done for hyperbolic and cylindrical ion traps.

It is another object of the present invention to provide an array of rectilinear ion traps for mass storage, mass analysis and mass separation.

It is still a further object of the present invention to provide an array of rectilinear ion traps which allow various combinations of gas phase processes to be applied to the ion traps to achieve high sensitivity, high selectivity and/or higher throughput ion analysis.

A rectilinear ion trap is provided which includes spaced x and y pairs of flat electrodes disposed in the zx and zy plane to define a trapping volume, an RF voltage source for applying RF voltages between the x and y pairs of electrodes to generate RF trapping fields in the xy plane end electrodes at the ends of the trapping volume defined by said pairs of x and y electrodes, a DC voltage source for applying DC voltages at least to said end electrodes to provide DC trapping fields along the z axis whereby ions are trapped in the trapping volume, and an AC voltage source for applying AC voltages to at least one pair of said spaced x or y electrodes to excite ions in the corresponding zx or zy plane. The end electrodes may comprise plates or pairs of flat electrodes disposed in the xy plane or a combination. An AC voltage can be applied to the end electrodes to excite ions in the z direction. The RF electrodes and end plates may include slits or aperatures for ejection injection of ions in the x, y and z directions.

A multistage ion processing system is provided which includes a plurality of rectilinear ion traps coupled to one another whereby ion can be transferred between traps. The traps are arranged in series or parallel or a combination thereof for ion transfer between traps in the x, y or z direction.

BRIEF DESCRIPTION OF THE DRAWINGS

The invention will be clearly understood from the following description when read in connection with the accompanying drawings of which.

DESCRIPTION OF PREFERRED EMBODIMENT

FIGS. 1–4 illustrate four rectilinear ion trap geometries and the DC, AC and RF voltages applied to the electrode plates to trap and analyze ions as the case may be. The trapping volume is defined by x and y pairs of spaced flat or plate RF electrodes 11, 12 and 13, 14 in the zx and zy planes. Ions are trapped in the z direction by DC voltages applied to spaced flat or plate end electrodes 16, 17 in the xy plane disposed at the ends of the volume defined by the x, y pair of plates, FIGS. 1 and 2, or by DC voltages applied together with RF in sections 18, 19 each comprising pairs of flat or plate electrodes 11*a*, 12*a* and 13*a*, 13*b*, FIG. 3. In addition to the RF sections flat or plate electrodes 16, 17 can be added, FIG. 4. The DC trapping voltages are illustrated in FIGS. 1*b*, 2*b*, 3*b* and 4*b* for each geometry. The ions are trapped in the x, y direction by the quadrupolar RF fields generated by the RF voltages applied to the plates. As will be presently described, ions can be ejected along the z axis through apertures formed in the end electrodes or along the x or y axis through apertures formed in the x or y electrodes. The ions to be analyzed or excited can be formed within the trapping volume by ionizing sample gas while it is within the volume, as for example, by electron impact ionization, or the ions can be externally ionized and injected into the ion trap. The ion trap is generally operated with the assistance of a buffer gas. Thus when ions are injected into the ion trap they lose kinetic energy by collision with the buffer gas and are trapped by the DC potential well. While the ions are trapped by the application of RF trapping voltages AC and other waveforms can be applied to the electrodes to facilitate isolation or excitation of ions in a mass selective fashion as described in more detail below. To perform an axial ejection scan the RF amplitude is scanned while an AC voltage is applied to the end plates. Axial ejection depends on the same principles that control axial ejection from a linear trap with round rod electrodes (U.S. Pat. No. 6,177,668). In order to perform an orthogonal ion ejection scan, the RF amplitude is scanned and the AC voltage is applied on the set of electrodes which include an aperture. The AC amplitude can be scanned to facilitate ejection. Circuits for applying and controlling the RF, AC and DC voltages are well known.

Figure 3A:
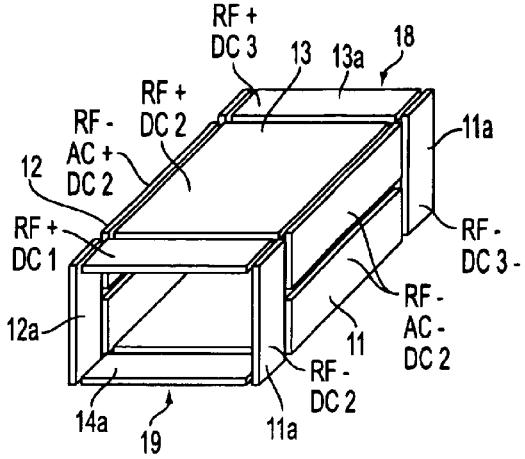
FIGS. 3*a–b* show a rectilinear ion trap with three RF sections and DC trapping voltages.
Figure 3B:
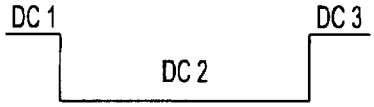
Figure 4A:
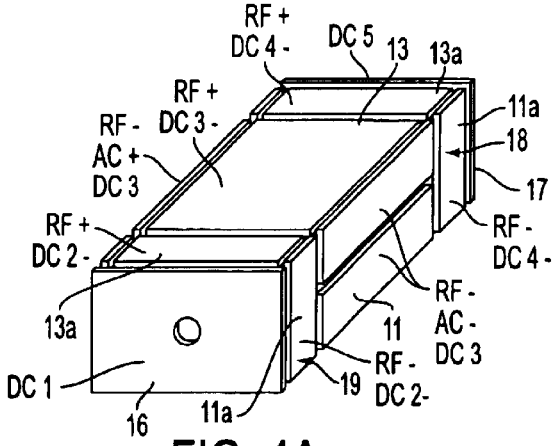
FIGS. 4*a–b* shows a rectilinear ion trap with three RF sections and end plates and DC trapping voltages.
Figure 4B:
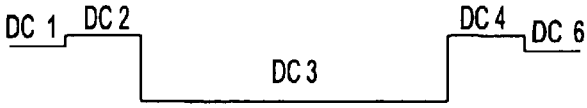

Ions trapped in the RIT can drift out of the trap along the z axis when the DC voltages are changed so as to remove the potential barriers at the end of the RIT. In the RIT configuration of FIG. 1, the distortion of the RF fields at the end of the RIT may cause undesirable effects on the trapped ions during processes such as isolation, collision induced dissociation (CID) or mass analysis. The addition of the two end RF sections 18 and 19 to the RIT as shown in FIGS. 3*a* and 4*a* will help to generate a uniform RF field for the center section. The DC voltages applied on the three sections establish the DC trapping potential and the ions are trapped in the center section, where various processes are performed on the ions in the center section. In cases where ion isolation or ion focusing is needed, end electrodes 16, 17 can be installed as shown in FIG. 4. Thus FIGS. 1–4 and other figures to be described merely indicate the applied voltages from the suitable voltage sources.

Figure 5:
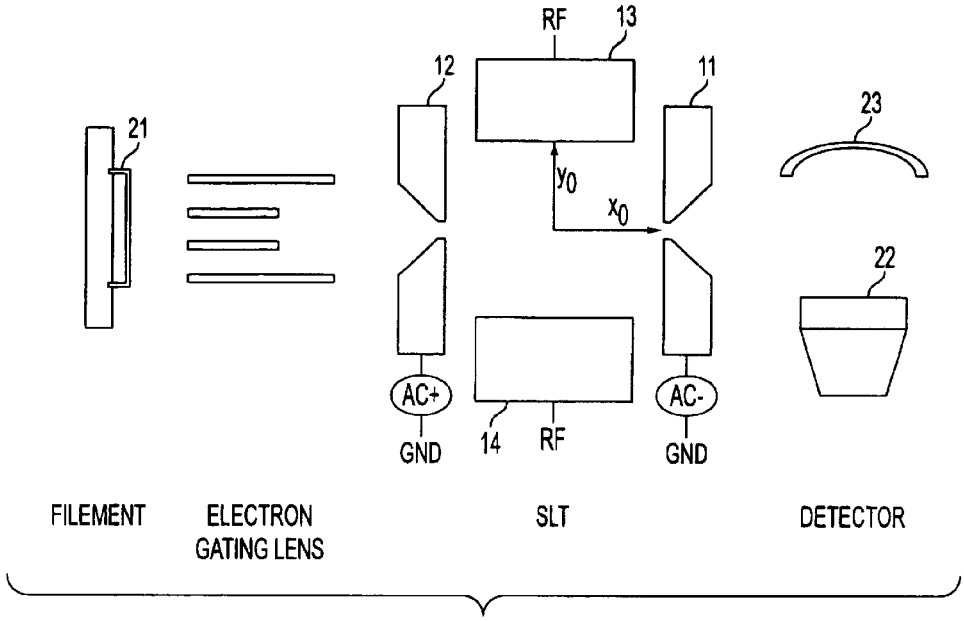
FIG. 5 schematically shows a rectilinear ion trap of the type shown in FIG. 2 in a mass analyzing system.

To demonstrate the performance of a rectilinear ion trap an analyzing system was built and tested using a rectilinear ion trap (RIT) in an ITMS system sold by Thermo Finnigan, San Jose, Calif. The RIT was of the type illustrated in FIG. 2 and the complete system is schematically shown in FIG. 5. The half-distance between the two electrodes in the x direction with the slits ($x_0$) and the two electrodes in the y direction ($y_0$) ws 5.0 mm. The distance between the x and y electrodes and the z electrode was 1.6 mm. The length of the x and y electrodes was 40 mm. The slits in the x electrodes were 15 mm long and 1 mm wide and located centrally. The RF voltage was applied at a frequency of 1.2 MHz and was applied between the y electrodes and ground. An AC dipolar field was applied between the two x electrodes 11, 12. A positive DC voltage (50 to 200 V) was applied to the z electrodes 16, 17, FIG. 2, to trap positive ions within the RIT along the z direction. Helium was added as buffer gas to an indicated pressure of $3\times10^{-5}$ torr.

Figure 6:
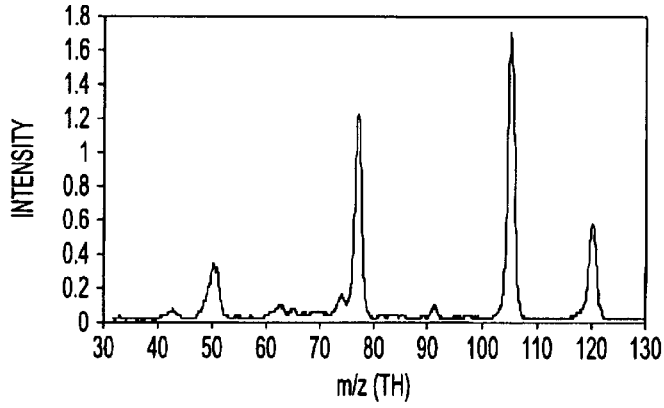
FIG. 6 shows the mass spectrum for acetophenone obtained with the system of FIG. 5.

In the experiment volatile compounds to be analyzed were leaked into the vacuum chamber to an indicated pressure of $2\times10^{-6}$ torr. The electrons emitted from the filament 21 were injected into the RIT to ionize the volatile compound and ions were formed inside the RIT through electron impact (EI) ionization. The ions were trapped by the applied RF and DC fields. After a period of cooling, the RF was ramped and the ions were ejected through the slit on the x electrode and detected by an electron multiplier 22 equipped with a conversion dynode 23. FIG. 6 shows a mass spectrum of acetophenone recorded in the experiment. The spectrum shows relatively abundant molecular and the fragment ions typically seen for this compound in other types of mass spectrometers.

Figure 7:
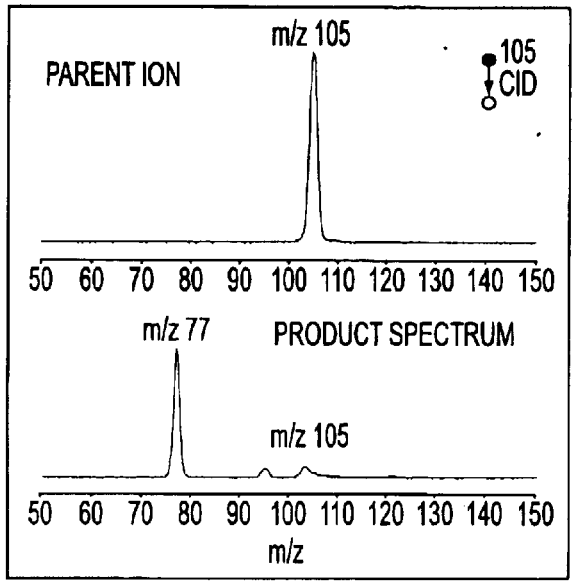
FIG. 7 shows the mass spectrum of the parent m/z 105 ion of acetophenone and the fragment ion m/z 105 obtained by CID in the system of FIG. 5.

The MS/MS capabilities of the RIT were tested as well. The fragment ion m/z 105 of acetophenone was isolated using RF/DC isolation and then excited by applying an AC field of 0.35 V amplitude and 277 kHz frequency. The isolation of the parent ion and the MS/MS product ion spectrum is shown in FIG. 7.

Figure 8:
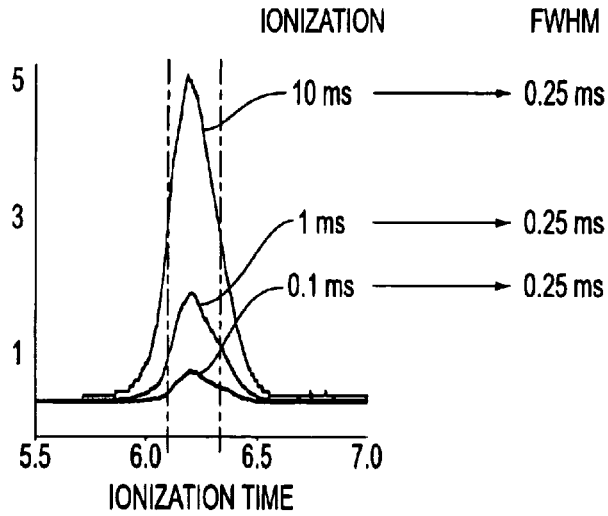
FIG. 8 shows the effects of ionization of dichlorobenzene for different times to obtain the ion of mass m/z 111.

The trapping capacity was tested using the onset of observable space charge effects ("spectral limit") as a criterion by which to estimate the number of trapped ions. When the number of ions exceeds the spectral limit for space charge, the resolution of the spectrum becomes noticeably poorer. To characterize the spectral limit of the RIT, dichlorobenzene was ionized using an ionization time of 0.1, 1 and 10 ms (0.1 is the shortest ionization time which can be set using the ITMS control electronics; when an ionization time longer than 10 ms was used, the signal intensity exceeded the limits of the detector). The trapped ions were mass analyzed in the RIT to generate the spectra. The peak shape of m/z 111 was used to compare the mass resolution for each ionization time as shown in FIG. 8. The FWHM of the peak does not change when the ionization varies 100 fold from 0.1 ms to 10 ms, which means the spectral limit (defined below) has not been reached at the limit of the dynamic range of the electron multiplier.

The relationship between the mass charge ratio of the ions that are trapped, the geometry of the RIT and the applied RF and DC voltages can be estimated by the following equations:

$$\frac{m}{e} = A_2 \frac{8V_{RF}}{q_x x_0^2 \Omega^2} \quad \text{Eq. 1}$$

$$\frac{m}{e} = -A_2 \frac{16U_{DC}}{a_x x_0^2 \Omega^2} \quad \text{Eq. 2}$$

where $A_2$ is the quadrupole expansion coefficient in the multipole expansion expression of the electric field, $V_{RF}$ and $U_{DC}$ are the amplitudes of the RF and DC voltages applied between the x and y electrodes, $a_x$ and $q_x$, are the Mathieu parameters, $x_0$ is the center to x electrode distance, and $\Omega$ is the frequency of the applied RF. The secular frequency $\omega_u$ (u=x or y) can be estimated by:

$$\omega_u = \frac{1}{2}\beta_u \Omega \quad \text{Eq. 3}$$

where $$\beta_u^2 = a_u + \cfrac{q_u}{(\beta_u+2)^2 - a_u - \cfrac{q_u^2}{(\beta_u+4)^2 - a_u - \cfrac{q_u^2}{(\beta_u+6)^2 - a_u - \dots}}} + \cfrac{q_u}{(\beta_u-2)^2 - a_u - \cfrac{q_u^2}{(\beta_u-4)^2 - a_u - \cfrac{q_u^2}{(\beta_u-6)^2 - a_u - \dots}}} \quad \text{Eq. 4}$$

Figure 9:
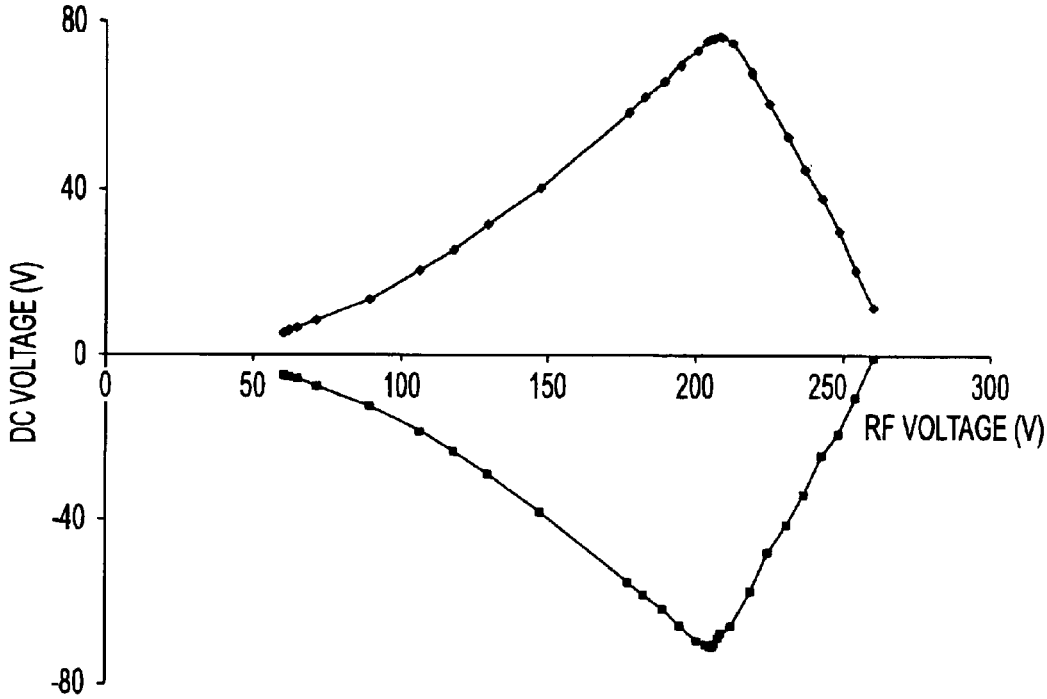
FIG. 9 shows the stability diagram mapped using RF and DC voltages for the rectilinear ion trap (defined below)

The stability diagram for the RIT is shown in FIG. 9.

As seen from the foregoing equations, by the application of RF voltage of predetermined frequency to the RF electrodes and DC voltages to the range which also depends upon the dimensions of the ion trap. The trapped ions can be isolated, ejected, mass analyzed and monitored. Ion isolation is carried out by applying RF/DC voltages to the x y electrode pairs. The RF amplitude determines the center mass of the isolation window, and the ratio of RF to the DC amplitude determines the width of the isolation window. Another method of isolating ions would be to trap ions over a broad mass range by the application of suitable RF and DC voltages and then to apply a wide band waveform containing the secular frequencies of all ions except those that are to be isolated. The wave form is applied between two opposite (typically x or y) electrodes for a predetermined period of time. The ions of interest are unaffected while all other ions are ejected. The secular frequency for any ion of any given m/z value can be determined from Equation 3 and can be changed by varying the RF amplitude. Trapped ions can be excited by applying an AC signal having a frequency equal to the secular frequency of the particular ion to be excited applied between two opposite RF electrodes. Ions with this secular frequency are excited in the trap and can fragment or escape the trapping field. The similar process can be deployed by applying the AC signal to the end electrodes. DC voltage pulses can be applied between any two opposite electrodes and the trapped ions of a wide mass range can be ejected from the RIT.

The RIT can be used to carry out various modes of mass analysis as described in the following:

a) Non-Scanning Ion Monitoring

Figure 1A:
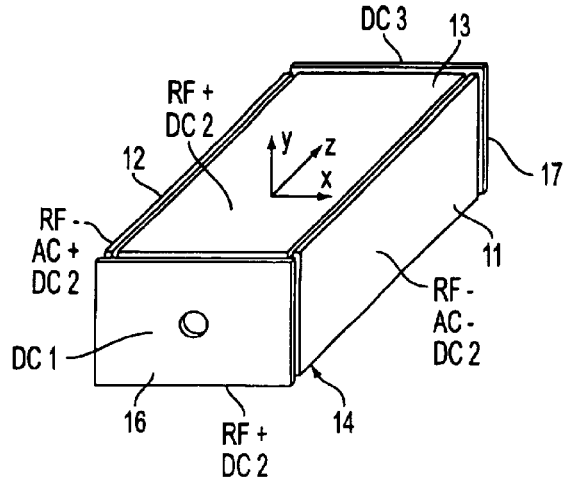
FIGS. 1*a–b* show a rectilinear ion trap which allows injection/ejection of ions along the z axis and DC trapping voltages.
Figure 1B:
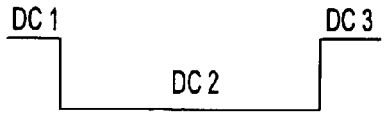
Figure 2A:
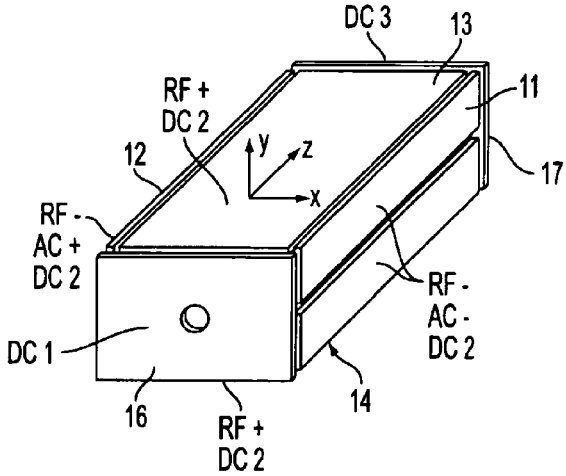
FIGS. 2*a–b* show a rectilinear ion trap with slits for ion injection/ejection along the x axis and DC trapping voltages.
Figure 2B:
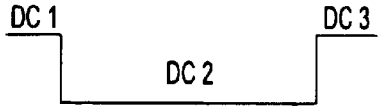

Using the simplest configuration, as shown in FIG. 1, single or multiple ion monitoring can be achieved by performing ion isolation and RF amplitude adjustments. Isolation of the ions of interest can be achieved by using the RF/DC (mass selective stability) or the waveform methods described above.

i) For single-ion monitoring, ions of interest are isolated and then allowed to drift out of RIT in z direction by lowering the DC trapping field for detection or they can be pulsed out or AC excited out.

ii) For multiple-ion monitoring, ions of several m/z values are monitored in sequence using multiple instances of the single ion monitoring method described above.

iii) For $MS^n$ mass analysis, ions with m/z values of interest are isolated, excited by application of an AC voltage and fragment through CID. The product ions can be mass analyzed by single- or multiple-ion monitoring.

b) Scanning Ions Through the Apertures on the End Electrodes

Figure 10A:
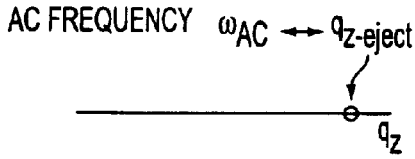
FIGS. 10*a*–10*b* show the AC and RF voltages for mass selective ion ejection along the z axis through a hole in the end electrode of the rectilinear ion trap of FIG. 1.
Figure 10B:
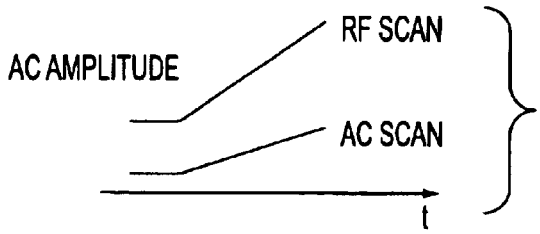
Figure 11:
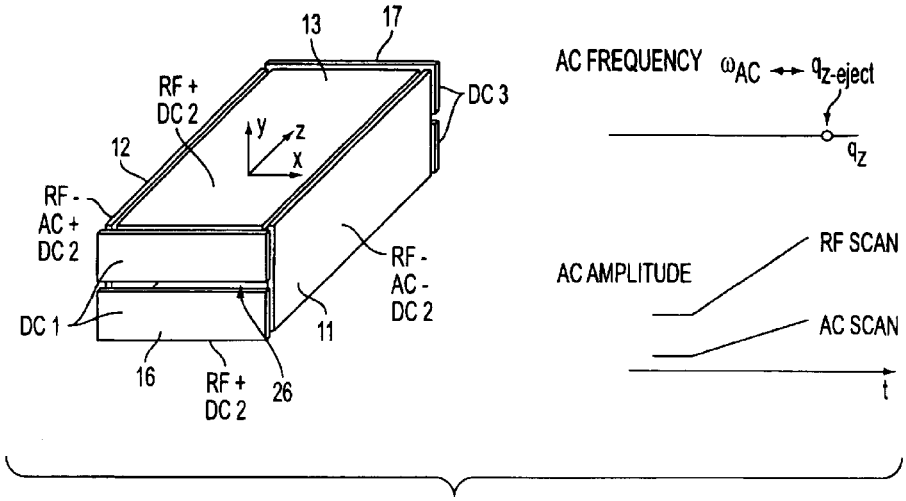
FIG. 11 shows a rectilinear ion trap for mass selective ejection through a slit in the end electrode with AC applied between the x electrodes.
Figure 12:
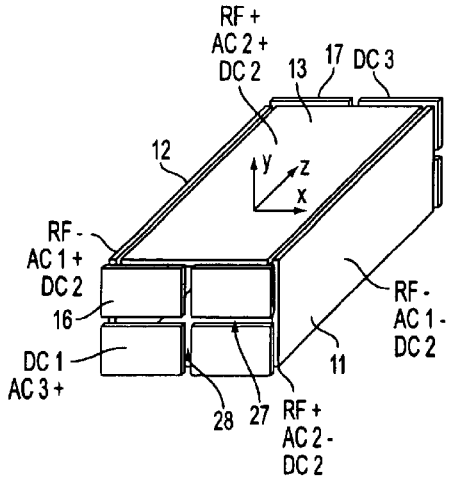
FIG. 12 shows a rectilinear ion trap for mass selective ejection through slits in the end electrode with AC applied either between the x or y electrodes.
Figure 13:
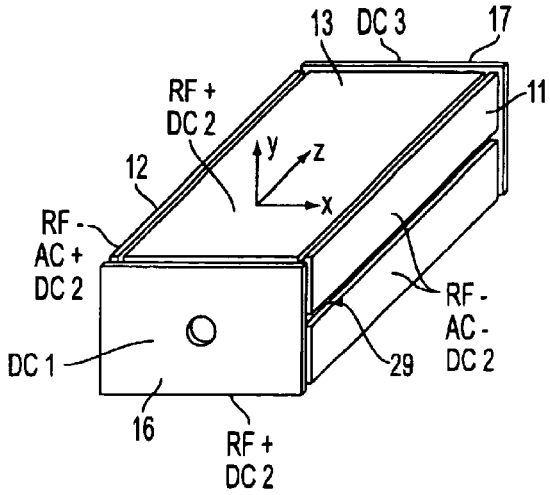
FIG. 13 shows a rectilinear ion trap for scanning ions through slits on the x RF electrodes by application of an AC scanning voltage to the x electrodes.
Figure 14:
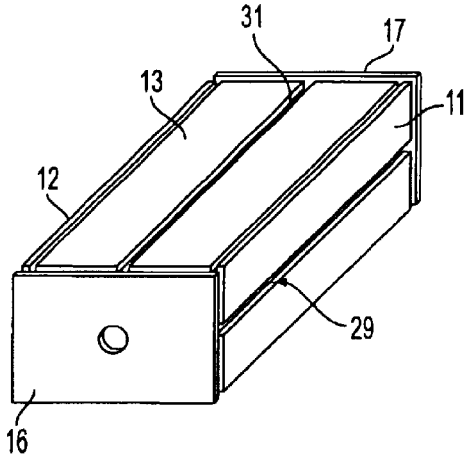
FIG. 14 shows a rectilinear ion trap for scanning ions through slits on the x or y RF electrode by application of an AC scanning voltage to the corresponding electrodes.

Mass instability scan can be implemented using an RIT with the geometry shown in FIG. 11.

i) An AC signal is applied between the x (or y) electrodes, and scanned while the RF is scanned, FIG. 10*b*. The ions are mass-selectively ejected in the appropriate direction according to their m/z values (low to high) FIG. 10*a*. The opening in the end plate 16 should be a slit 26, FIG. 11, along the x axis to allow the ions oscillated by the AC signal along the x axis to be effectively ejected.

ii) Double slits 27, 28 (crosses) in the end plate of the RIT, FIG. 12, allow the AC to be applied between either the x or y electrodes or both. The orientation (along the x or y axis) of the ion beam ejected from the RIT is selected by choosing the electrode pair (x or y) to apply the AC. This selection is appropriate in the cases where the ejected ion cloud shape needs to match the opening of next device, for instance, another RIT. If AC voltages of different frequencies are applied to the x and y electrodes, ions of two different masses are ejected from the slits.

c) Scanning Ions through the Slits in the RF Electrodes i) By adding openings or slits 29 on the x (or y) electrodes and applying an AC voltage with selected frequency between these two electrodes, ions can be mass selectively ejected through the slits by scanning the RF amplitude, FIG. 13. Typically, the amplitude of the AC voltage can also be scanned to achieve better resolution.

ii) The RIT shown in FIG. 14 has slits 29 and 31 on both the x and y electrodes. The ejection direction can be selected by choosing the electrode pair, x or y, or both, to apply the AC signal. Ions of different masses can be ejected from each of the slits.

d) Scanning Ions through Electrodes in Any Direction

Figure 15:
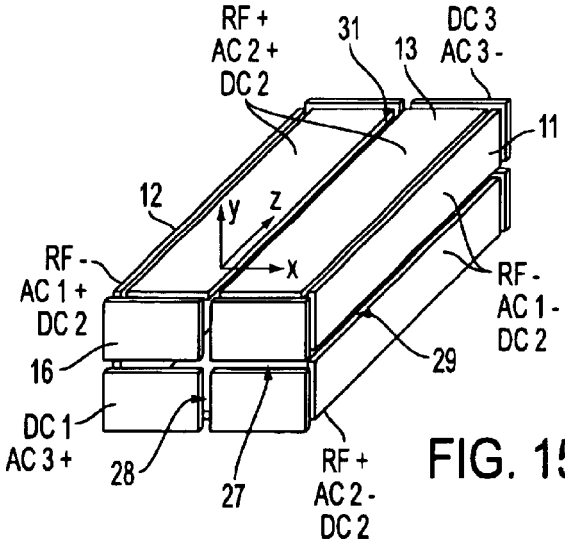
FIG. 15 shows a rectilinear ion trap with slits in the RF and end electrodes allowing ions to be ejected in any direction.
Figure 16:
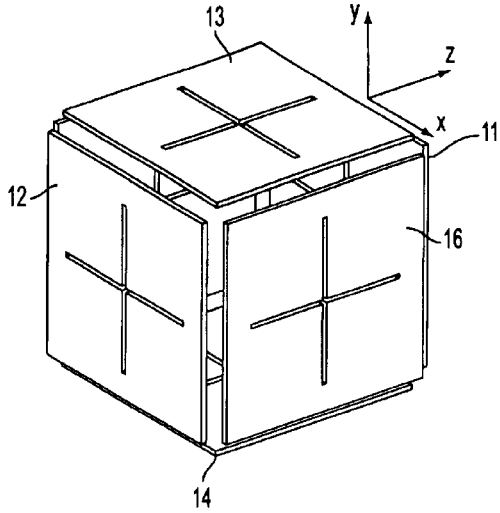
FIG. 16 shows a cubic rectilinear ion trap with crossed slits in each electrode whereby application of RF and AC voltages between selected pairs of electrodes allows ion ejection in the x, y or z direction.
Figure 17:
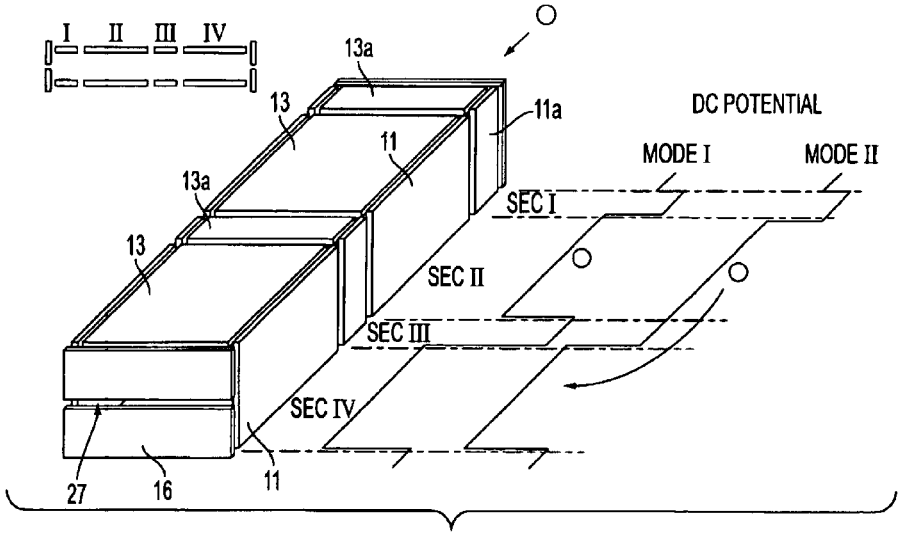
FIG. 17 shows a serial combination of rectilinear ion traps and applied DC voltages.
Figure 18:
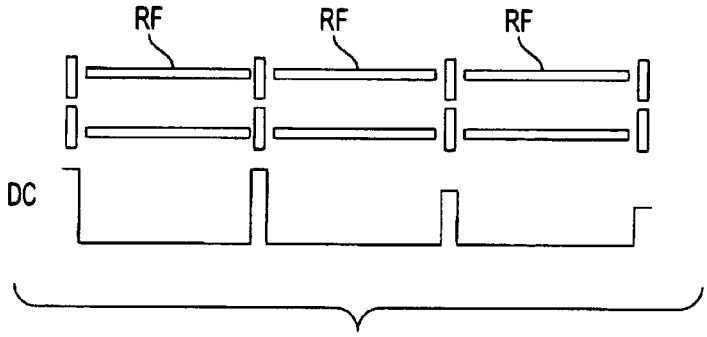
FIG. 18 schematically shows a serial array of ion traps of the same size.
Figure 20:
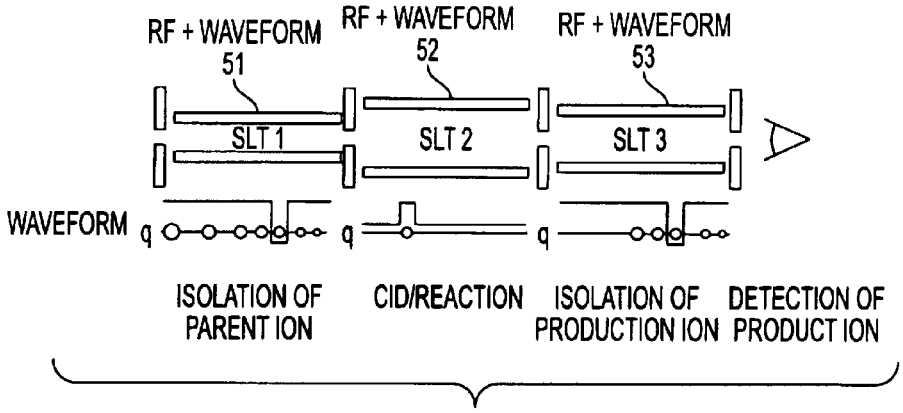
FIG. 20 schematically shows a serial array of rectilinear ion traps of different sizes.
Figure 19A:
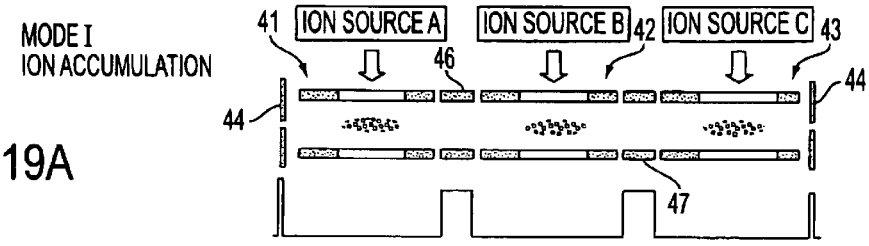
FIG. 19*a–e* schematically show various operational modes for three serially connected rectilinear ion traps.
Figure 19B:
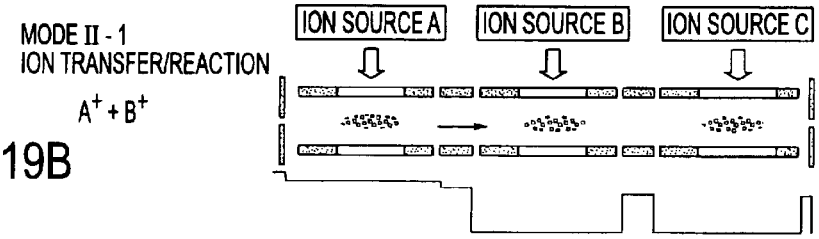
Figure 19C:
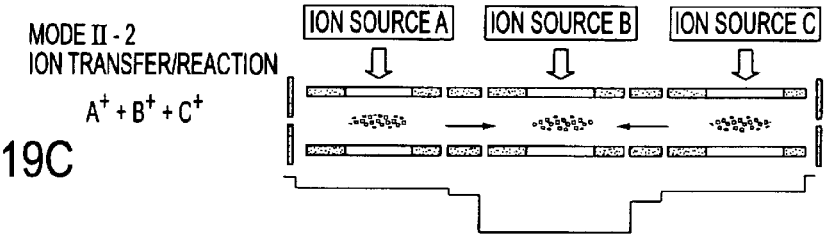
Figure 19D:
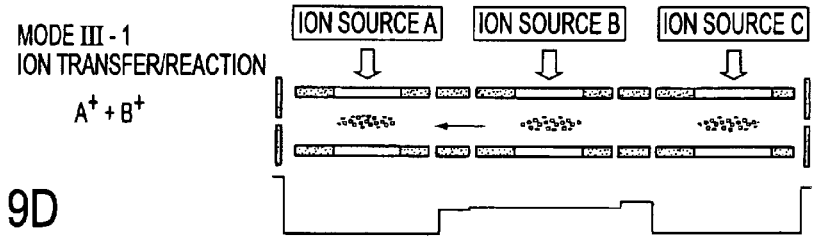
Figure 19E:
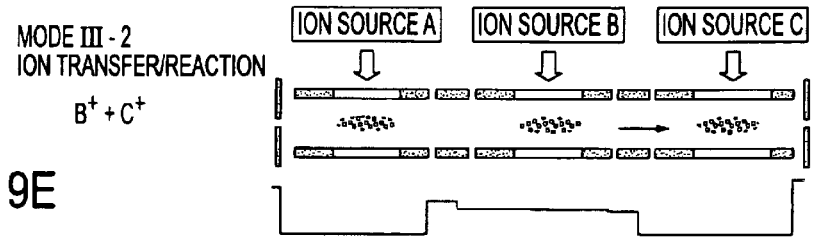

The RIT device shown in FIG. 15 combines the features of the configurations described above and allows ion injection and mass selective or non-selective ejection along any of the x, y or z axes. This type of RITs can transfer ions along any of the x, y or z directions by applying a DC pulse or an AC signal to the corresponding electrodes. The selection rules are as described above. An alternative geometry, cubic, with symmetric features on each of the electrodes is shown in FIG. 16.

i) RF signals that differ in phase by 120 degrees can be applied to each pair of electrodes in the cubic device, FIG. 16, to establish a (rotating) 3D RF trapping field.

ii) The RF trapping plane and the DC trapping axis can be selectively changed by choosing the electrode pair(s) to which to add RF or DC. The ejection modes using AC and DC can be applied by adding AC or DC signals to the corresponding electrodes. This device can work as a direction switcher in ion transfer operations.

iii) An alternative trapping mode: Any two pairs of electrodes can be electrically connected to the same RF signal to form a "cubic trap" analogous to that in a cylindrical ion trap, and the other pair can act like a pair of endcaps by being grounded or being supplied with an RF 180 degrees different in phase.

e) Rectilinear Ion Traps can be Combined Multilaterally to Construct Various Devices.

i) A typical serial arrangement of RITs is shown in FIG. 17. The arrangement uses two RITs, sections II and IV, with RF trapping sections I and III and end plate 31 through which ions are introduced and end plate 32 with slot 33. The DC trapping voltages 34 and 36 applied to the electrodes are schematically shown. In Mode I, the DC potential wells are set up in a way that ions can be trapped in section II and section IV. In Mode II, the ions in section II are allowed to transfer to Section IV. Section III is used to minimize the interference between section II and IV, where different operations are performed on the ions. As one example, ions can be accumulated (mass-selectively or non-selectively) in section II while at the same time various operations like isolation, CID, ion/ion or ion molecule reactions, and mass selective ejection, can be performed in section IV.

ii) FIG. 18 shows RITs of the same size arranged in a serial configuration to act like a tandem mass spectrometer with properties that resemble a triple quadrupole mass spectrometer. The ions are transferred from one RIT to the next by changing the DC potentials in the same manner as shown in FIG. 17.

iii) FIGS. 19*a–e* show several operational modes of three RITs 41, 42 and 43 as for ion/ion reactions. Short RITs 46, 47 are used instead of end plate lenses for ion transfer to increase the ion transfer efficiency. FIG. 19*a* shows ions from external ion sources A, B and C injected into RITs 41, 42 and 43, respectively, where the ions are injected from ion source and accumulated in each by the application of DC trapping voltages to the end plates 44 short RF sections 46, 47 and RF voltage to the RITs 41, 42 and 43, FIG. 19*a*. By changing the DC trapping voltages as shown, ions trapped in RIT 41 are transferred to RIT 42 where they can react, FIG. 19*b*. FIG. 19*c* illustrates the DC voltages for transfer of accumulated ions from RITs 41, 43 into RIT 42. FIGS. 19*d* and 19*e* show DC voltages for transfer of ions from RIT 42 to RIT 41 and from RIT 42 to RIT 43, respectively. As one can notice, these operational modes have features significantly different from those for conventional serial configurations such as triple quadrupoles. The ions can be introduced in any stage in the structure; ions trapped in any stage can be isolated or excited to yield fragments; ions trapped in any stage can be transferred to others in both directions (forward and backward) to react with other ions or neutrals.

iv) Three RITs of different sizes, FIG. 20, are operated with a single RF signal of a constant amplitude. Two sets of waveforms, one for ion isolation and one for ion excitation, are applied to all x or y electrodes at different times to perform the desired operations. The size of the first RIT is selected based on the desired q for isolation of the parent ion. The equation used for the calculation of the size is:

$$x_0(\text{or } y_0) = \sqrt{\frac{keV_{RF}}{q\Omega^2 m}}, \qquad \text{Eq. 5}$$

where $x_0$ ($y_0$) is the half distance between the x (y) electrodes.

Figure 21:
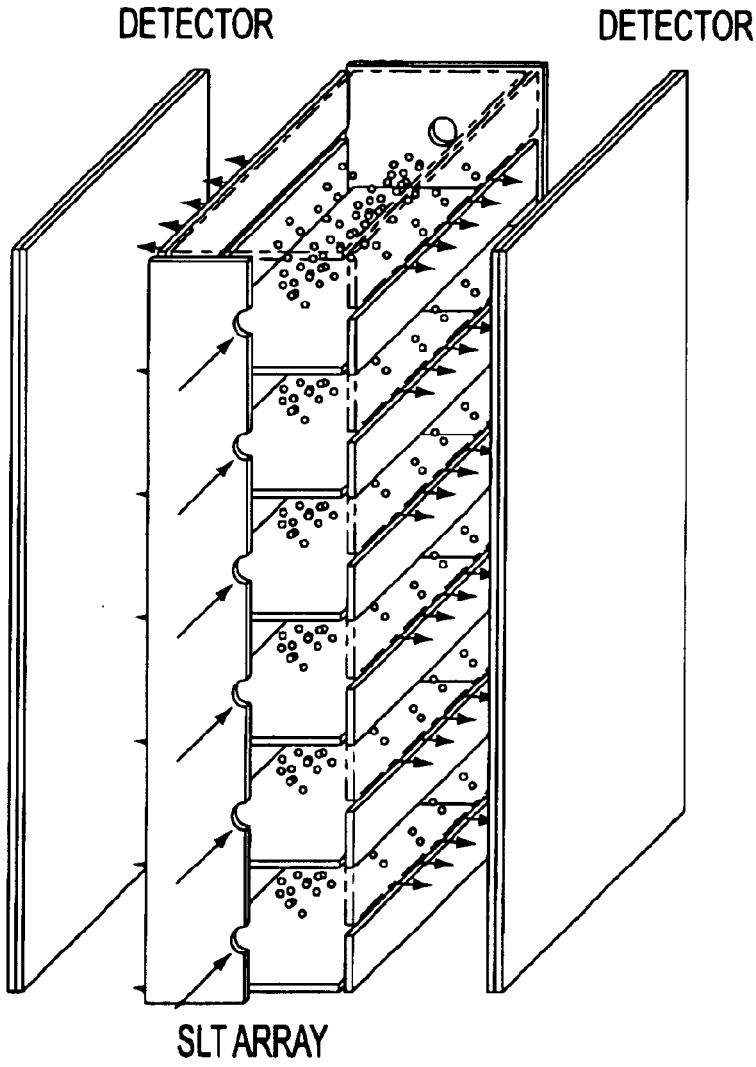
FIG. 21 is a perspective view showing a parallel array of rectilinear ion traps.
Figure 22:
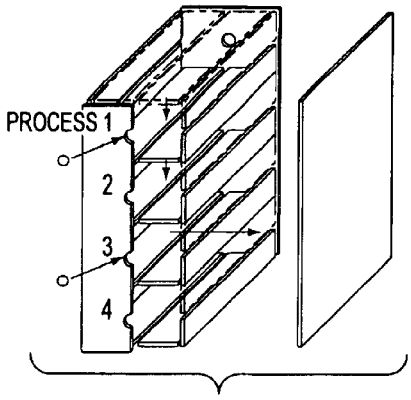
FIG. 22 is a perspective view showing a parallel array of rectilinear ion traps which performs a series of operations on an ion population.
Figure 23:
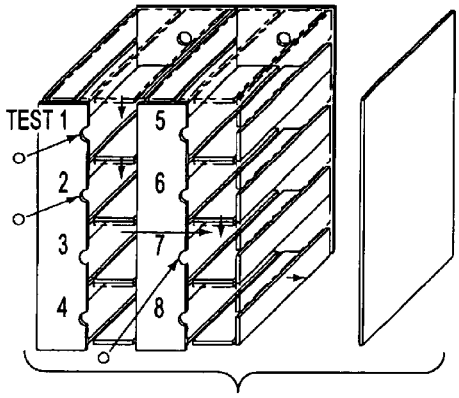
FIG. 23 is a perspective view showing two parallel arrays of rectilinear ion traps serially arranged.

Waveform I for ion isolation is also calculated based on this q. After ions are injected into RIT 51 and cooled, waveform I is applied and the parent ions of a desired m/z are isolated; the DC potentials along the beam axis are adjusted so that the parent ions are transferred into the second RIT 52. The size of RIT 52 is selected based on the parent ion m/z value and the desired q for CID or ion/molecule reactions and waveform II for CID is also calculated based on this q. The parent ions are fragmented by applying waveform II or reacting with molecules or other ions to generate product ions; the product ions are transferred to RIT 53 when the DC potentials are adjusted. The size of the third RIT is calculated based on the m/z of the product ion to be isolated and monitored. The q for isolation can be the same as that for RIT 51, so the same waveform can be used for isolation in RIT 53; the size of RIT 53 is calculated based on the q and the m/z value of the ions to be isolated/monitored. The isolated ions are ejected for external detection. This type of serial arrays provides analysis processes such as $MS^n$ using RITs without requiring dedicated electronics to scan RF voltages. The isolation in RIT I and III can also be achieved using RF/DC isolation at the appropriate q value.

v) Because of their rectangular shape and the ability to eject ions in the x and y direction as well as the z directions, it is possible to have parallel arrays as well as serial arrays and combination serial and parallel arrays. FIG. 21 shows ions from a single sample injected in the z direction into all the RITs of a parallel array, cooled and then mass analyzed. The total number of ions trapped and detected is proportional to the number of RITs and the sensitivity of the multiple-channel RIT array mass. Ions from different samples can be injected into different RITs and each RIT can serve as an independent mass analyzer. Individual detectors, not shown, can be used for each channel or imaging detectors which process spatially resolved signals can be used to detect the ejected ions. Analytes in multiple samples can be ionized and mass analyzed simultaneously to achieve high-throughput analysis of large numbers of samples. The same parallel array can also be used to perform high-selectivity analysis by allowing the ions to go through various selective processes in the gas phase before final mass analysis and detection. As shown in FIG. 22, the ions injected into RIT 1 can be mass-selectively isolated, then transferred through a slot in the electrode into RIT 2 for ion/molecule reactions, transferred through a slot in the electrode into RIT 3 for ion/ion reactions and then mass-analyzed by ejecting through a slot in the electrode. Obviously, the device can have more channels to allow more processes in the high-selectivity mode as well as stronger signals in the high-sensitivity mode and more samples to be analyzed simultaneously in the high-throughput mode. FIG. 23 shows the combination of parallel arrays serially connected.

Figure 24:
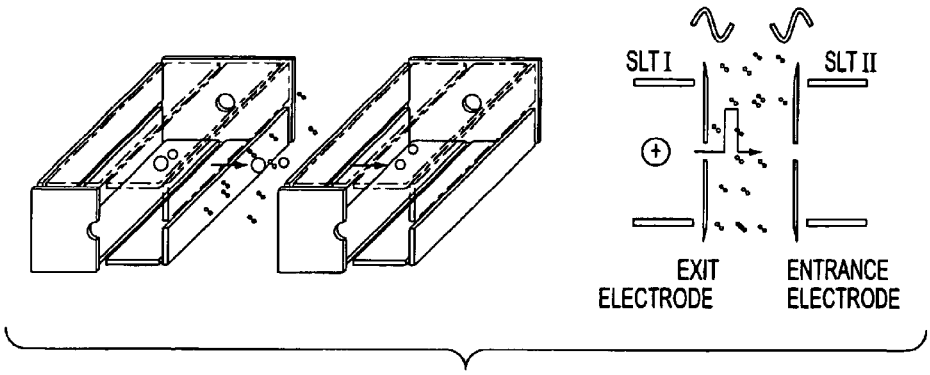
FIG. 24 is a perspective view of a parallel array for ion mobility measurement.
Figure 25:
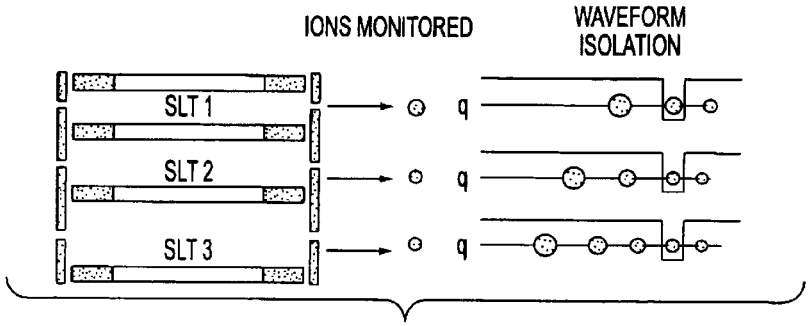
FIG. 25 schematically shows a parallel array of rectilinear ion traps of variable sizes for non-RF-scan multiple process analysis.
Figure 26:
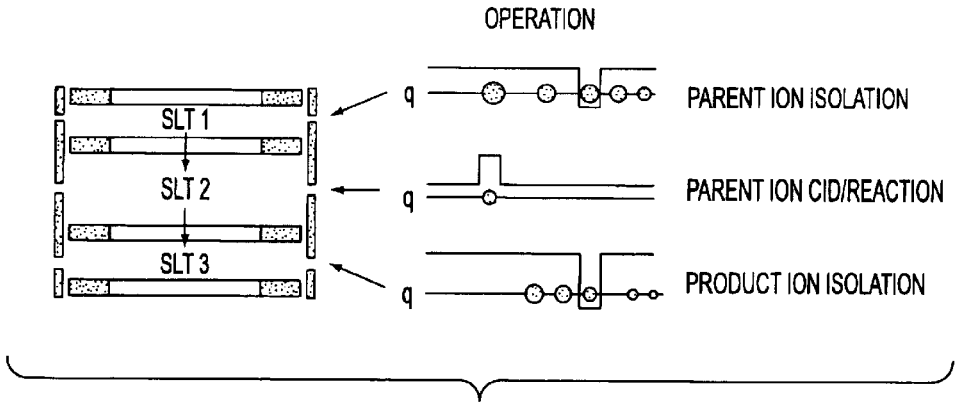
FIG. 26 schematically shows another parallel array of rectilinear ion traps of variable sizes for non-RF-scan multiple process analysis.

The capability to transfer ion populations into adjacent traps in either the x or y direction allows ions of given mass/charge ratio to be placed anywhere within a three dimensional ion trapping array. The ability to fix spatial positions of chemically distinctive species allows a variety of potential applications including (i) pattern transfer to adjacent surfaces by ion/surface reactions and ion soft-landing; (ii) ion annihilation experiments in which ions of opposite charge are stored in adjacent elements before the electrodes potentials are reduced to allow reactive mixing (iii) high density information storage consisting of three spatial dimensions and one mass/charge dimension.

vi) When the ions are transferred from one RIT to another using a DC pulse, as shown in FIG. 24, the ions ejected from the first RIT can only enter the second RIT during a very specific narrow RF phase window. The ions leaving the exit slit of the first RIT at the same time may not reach the entrance slit of the second RIT at the same time due to the difference in the collision cross-section for collisions with He. By carefully selecting either the ejection RF phase, the distance between the RITs, or the pressure of He, ions with different cross-section will be separated in space due to the different ion mobility and some of them can be trapped in the second RIT and others may not. In comparison the ions in the first RIT and the ions trapped in the first RIT, the cross-sections of the ions can be estimated.

vii) Just as in the case of serial RITs, parallel RITs of different sizes can be operated with a single RF signal at constant amplitude. The RIT sizes can be calculated using Eq 1 such that the ions to be monitored in each RIT are operated at the same q value for ion isolation. As shown in FIG. 25, a single waveform with a notch at the same q is applied to all RITs and the ions with corresponding m/z values or ranges of m/z values are isolated and trapped in each RIT. The trapped ions are later ejected along the x/y or z direction to be detected. The alternative ion isolation method is RF/DC isolation. FIG. 26 shows an alternative arrangement for a parallel array. Instead of transferring ions along the z axis, the ions are transferred along the y axis and sequentially experience the processes illustrated in the serial array of FIG. 20.

Figure 27:
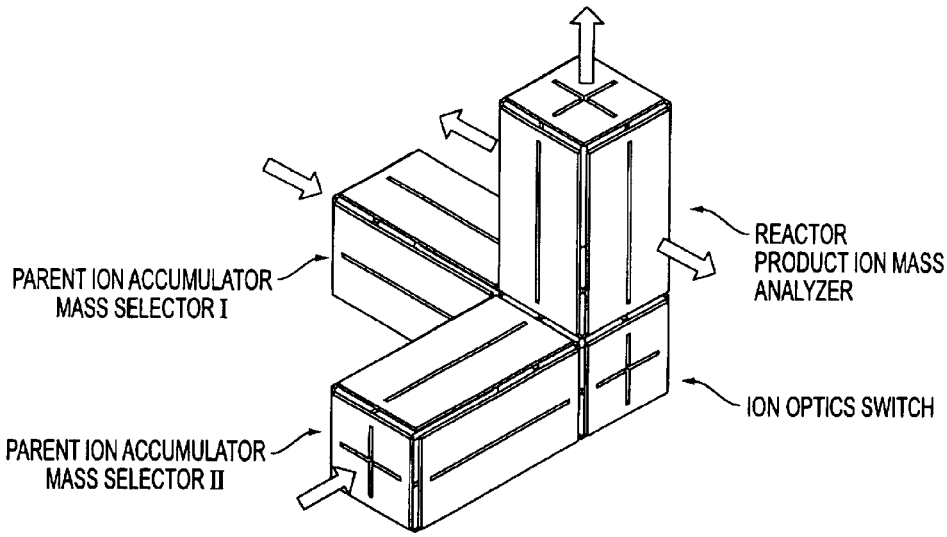
FIG. 27 is a perspective view of rectilinear ion traps arranged in a three dimensional array.

Another way to construct an RIT array is to use the cubic ion trap as the joint between RITs (FIG. 27). The ions from one RIT can be transferred into the cubic trap, stored and then transferred into the next RIT. With the same configuration, the ions injected into the cubic trap can be transferred in any of the six directions by applying DC pulse or AC waveforms. The RITs of different sizes can be connected using the cubic traps to form various arrays.

The foregoing are only examples of how RITs can be used and combined to carry out analysis and manipulation of ions. The plate configuration facilitates and simplifies the fabrication of ion traps. The simple rectangular configuration of the ion trap permits multilateral combinations of rectilinear ion traps.

What is claimed is:

1. A rectilinear ion trap mass analyzer comprising:

spaced x and y pairs of flat RF electrodes disposed in the zx and zy plane to define a trapping volume;

an RF voltage source for applying RF voltages between the x and y pairs of electrodes to generate RF trapping fields in the xy plane;

end electrodes at the ends of trapping volume defined by said pairs of x and y electrodes;

a DC voltage source for applying DC voltages to said at least end electrodes to provide DC trapping fields along the z axis whereby ions are trapped in the trapping volume; and an AC voltage source for applying AC voltages to at least one pair of said spaced x or y electrodes to excite ions in the corresponding zx or zy plane.

2. A rectilinear ion trap, as in claim 1 in which the end electrodes comprise plates disposed in the xy plane.

3. A rectilinear ion trap, as in claim 1 in which the end electrodes comprise spaced pairs of flat end RF electrodes disposed in the zx and zy plane.

4. A rectilinear ion trap, as in claim 3 including end plates disposed in the xy plane at the ends of said spaced pairs of flat end RF electrodes.

5. A rectilinear ion trap, as in claims 2 or 4 in which at least one of said end plates includes a slit oriented in the same direction as the applied AC voltage whereby to enhance ion ejection in the z direction.

6. A rectilinear ion trap, as in claims 2 or 4 in which at least one of said end plates includes slits oriented in the x and y directions.

7. A rectilinear ion trap, as in claim 1 in which at least one of the x or y pairs of plates to which the AC voltage is applied includes a slit or elongated aperture oriented in the z direction.

8. A rectilinear ion trap, as in claim 5 in which at least one plate of the x and y electrodes includes a slit or elongated aperture.

9. A rectilinear ion trap, as in claim 2 in which the x and y electrodes and the end electrode define a cubic trapping volume and all of the plates include crossed slits or elongated apertures.

10. The method of operating the ion trap of claim 1 to isolate ions of interest which comprises applying RF/DC isolation voltages to the RF electrodes to trap the ions of interest.

11. The method of claim 10 including applying an AC voltage to a pair of the RF electrodes after isolation of ions to fragment the ions.

12. The method of operating the ion trap of claim 1 to isolate ions of interest comprising applying a broadband AC voltage to a pair of the RF electrodes which has gaps in the frequency spectrum whereby ions are resonated out of the trap except for ions having an excitation frequency at the gap frequency.

13. The method of operating the ion trap of claim 5 which comprises applying an AC voltage to the RF pair of electrodes in the direction of the slit.

14. The method of operating the ion trap of claim 7 which includes applying RF trapping voltages to the RF electrodes and an AC voltage across the set of RF electrodes including the slit.

15. The method of operating the ion trap of claim 7 which includes applying an RF voltages, one set of RF electrodes and AC voltages of different frequency to the other sets of RF electrodes to eject ions of different masses in the x and y directions.

16. The method of operating an ion trap of claim 9 which comprises selecting the direction of motion of trapped ions by changing the combination of RF, AC and DC waveforms applied to the pairs of electrodes.

17. A multistage ion processing system including:

a plurality of rectilinear ion traps each comprising:

spaced x and y pairs of flat electrodes disposed in the zx and zy plane to define a trapping volume;

an RF voltage source for applying RF voltages between the x and y pairs of electrodes to generate RF trapping fields in the xy plane;

end electrodes at the ends of the trapping volume defined by said pairs of x and y electrodes;

a DC voltage source for applying DC voltages to said at least end electrodes to provide DC trapping fields along the z axis whereby ions are trapped in the trapping volume; and an AC voltage source for applying AC voltages to at least one pair of said spaced x or y electrodes to excite ions in the corresponding zx or zy plane said rectilinear ion traps coupled to one another whereby ion can be transferred between ion traps.

18. A multistage ion processing system as in claim 17 which comprises at least three rectilinear ion traps.

19. A multistage ion processing system as in claim 18 in which the end electrodes comprise end plates with at least one slit and the rectilinear ion traps are arranged in series whereby ions are transferred between ion traps in the z direction.

20. A multistage ion processing system as in claim 18 in which at least one of the flat electrodes disposed in the zx and zy direction includes a slit oriented in the z direction and the rectilinear ion traps are arranged in parallel whereby ions are transferred between ion traps in the x or y direction.

21. A multistage ion processing system as in claim 18 in which said plurality of rectilinear ion traps are combined in a serial and a parallel array.

22. A multistage ion processing system as in claim 18 in which said rectilinear ion traps are arranged with their axis orthogonally arranged and the traps are coupled to one another by a rectilinear ion trap whereby ions can be transferred in the x, y and z direction.

23. A multistage ion processing system as in claim 22 in which the coupling rectilinear ion trap is a cubic ion trap.

24. A multistage ion processing system as in claim 19 in which the RF electrodes of the traps have different spacing.

25. A multistage ion processing system as in claim 20 in which the RF electrodes of the traps have a different spacing.

* * * * *